US011382393B2

(12) United States Patent
Roi-Sanginario

(10) Patent No.: US 11,382,393 B2
(45) Date of Patent: Jul. 12, 2022

(54) JEWELRY PIECE WITH A SPRING CLOSURE FOR AN INTERCHANGEABLE ORNAMENT

(71) Applicant: Andria Arie, LLC, Westborough, MA (US)

(72) Inventor: R. Alexandria Roi-Sanginario, Concord, MA (US)

(73) Assignee: ANDRIA ARIE, LLC, Westborough, MA (US)

( * ) Notice: Subject to any disclaimer, the term of this patent is extended or adjusted under 35 U.S.C. 154(b) by 33 days.

(21) Appl. No.: 17/062,613

(22) Filed: Oct. 4, 2020

(65) Prior Publication Data

US 2021/0106102 A1 Apr. 15, 2021

Related U.S. Application Data

(60) Provisional application No. 62/914,701, filed on Oct. 14, 2019.

(51) Int. Cl.
*A44C 17/02* (2006.01)
*A44C 25/00* (2006.01)

(52) U.S. Cl.
CPC ..... *A44C 25/00* (2013.01)

(58) Field of Classification Search
CPC ..... A44C 17/0208; A44C 17/0216; A44C 17/0225; A44C 25/001; A44C 25/00; A44C 17/02; A44C 25/005; A44C 25/007
USPC ..... 63/23, 29.1, 40
See application file for complete search history.

(56) References Cited

U.S. PATENT DOCUMENTS

| | | | | |
|---|---|---|---|---|
| 1,182,534 | A * | 5/1916 | Driggott | A44C 17/0208 63/29.1 |
| 1,712,171 | A * | 5/1929 | Gustave | A44C 17/0208 63/29.1 |
| 3,307,375 | A | 3/1967 | Estrin et al. | |
| 3,509,734 | A * | 5/1970 | Lederer | A44C 17/0216 63/15 |
| 4,924,562 | A | 5/1990 | Pogharian | |
| 5,279,021 | A | 1/1994 | Edgin | |
| 5,435,047 | A * | 7/1995 | Colpo | A44C 5/2042 24/616 |
| 5,586,374 | A | 12/1996 | Nishida | |
| 6,481,065 | B2 | 11/2002 | Cogdill | |
| 6,484,537 | B2 | 11/2002 | Takessian | |
| 8,375,532 | B2 | 2/2013 | Yakubovich | |
| 9,021,835 | B2 | 5/2015 | Babyak | |

(Continued)

FOREIGN PATENT DOCUMENTS

WO WO 03/030671 A1 4/2003

*Primary Examiner* — Jack W Lavinder
(74) *Attorney, Agent, or Firm* — Chelini IP Law LLC; Kathryn Vesco Chelini

(57) ABSTRACT

A jewelry piece having a body or housing that defines a cavity sized and shaped to removably receive an interchangeable ornament, a cover or back connected to the body, such that the jewelry piece may be opened or closed, and a locking mechanism to secure the ornament in the jewelry piece. The body and cover mechanically engage when the jewelry piece is closed to secure the ornament without the need for excessive force or an additional tool. The mechanical engagement is accomplished by interlocking mating elements and a spring-loaded lever.

20 Claims, 17 Drawing Sheets

(56) References Cited

U.S. PATENT DOCUMENTS

| | | | | |
|---|---|---|---|---|
| 2004/0074259 | A1* | 4/2004 | Hartgrove ..... | A44C 17/0216<br>63/29.2 |
| 2010/0257706 | A1 | 10/2010 | Bak | |
| 2016/0051015 | A1 | 2/2016 | Powers | |
| 2021/0186167 | A1 | 6/2021 | Roi-Sanginario | |

* cited by examiner

JEWELRY PIECE WITH A SPRING CLOSURE FOR AN INTERCHANGEABLE ORNAMENT

CROSS-REFERENCE TO RELATED APPLICATIONS

This application claims the benefit of U.S. Provisional Patent Application No. 62/914,701, filed Oct. 14, 2019, which is incorporated by reference herein in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO SEQUENCE LISTING, TABLE OR COMPUTER PROGRAM LISTING

Not Applicable.

STATEMENT REGARDING PRIOR DISCLOSURES BY THE INVENTOR

Not Applicable.

BACKGROUND OF THE INVENTION

Field of the Invention

The present disclosure relates to jewelry, and more particularly to jewelry pieces or settings that allow for removable and interchangeable ornaments.

Description of the Background

It is often desirable to be able to change or replace an ornament in a piece of jewelry. For example, a wearer may tire of a piece of jewelry that has only a single, unchangeable ornament, or the ornament in the jewelry piece may become damaged, rendering the entire jewelry piece unusable. In addition, the wearer may want the ability to coordinate jewelry with clothing or accessories without having to purchase multiple jewelry pieces. Further, jewelry is often expensive and the ability to have one jewelry piece with multiple ornaments is cost-effective. The ability to use an expensive ornament in more than one jewelry piece or setting is similarly cost-effective.

Jewelry pieces with replaceable ornaments are known in the art. For example, U.S. Pat. No. 6,484,537, "Replaceable Gem Stone Setting for a Jewelry Piece," discloses a jewelry piece in which the replaceable gem is held in place by "a plurality of radially extending convergent and cantilevered spring blades." U.S. Pat. No. 6,742,359, "Jewelry Piece with a Changeable Decorative Article Setting," discloses the use of "a pivoted spring element . . . having bendable segments" to secure the decorative article. U.S. Pat. No. 7,201,021, "Jewelry Article Having Magnetic Elements and Interchangeable Settings," discloses "magnetically coupling body portions" where "at least one of the body portions is rotatable to tangentially break the magnetic coupling between the body portions to interchange the setting."

Prior art mechanisms for securing the ornaments to or into the jewelry piece or setting, however, may wear down over time. As a result, the ornament may be only loosely retained in the jewelry piece, and may tend to rattle, become misaligned, or even come out of the jewelry piece. The rattling may also damage the ornament. Prior art mechanisms that rely solely on magnets may not be reliable, in that the wearer's movements may cause the pieces that are coupled together by the magnets to separate, or the magnets may demagnetize. As a result, the ornament may be lost or damaged.

In addition, prior art mechanisms that secure the ornament may be difficult to use. In some cases, the user must open the securing mechanism by pushing or pulling on a very small tab or protrusion and pry the mechanism open. Since these tabs or protrusions are small, the user may try to open the mechanism with their fingernails, which may chip or break the fingernails. Also, if the user is struggling to open the mechanism, the user may lose their grip on the jewelry piece or the ornament, either of which may fall to the floor and get lost or damaged. Some mechanisms require an additional tool to open and/or close the securing mechanism, and those tools may be difficult to use and may get lost. In some cases, the securing mechanism may be bulky or not aesthetically appealing, which detracts from the attractiveness of the jewelry piece.

There is a need in the art for jewelry pieces in which the ornament may be quickly and easily changed and yet is firmly secured, does not rattle, and does not accidentally fall out or become dislodged. In addition, the jewelry piece should be particularly adapted to being held in a closed position while being worn to prevent accidental loss of the ornament.

Further, the jewelry piece should be easy to open and close, with a mechanism that is simple to operate and reliable, and does not require additional tools or excessive force. In addition, the securing mechanism should minimize exterior evidence of the interchangeability of the ornament.

There is also a need in the art for a collection of such jewelry pieces, such that multiple jewelry pieces, with matching or complementary, and interchangeable, ornaments may be worn at the same time. In addition, there is a need in the art for a collection of jewelry pieces where multiple pieces accept the same interchangeable ornaments.

BRIEF SUMMARY OF THE INVENTION

The present invention provides a jewelry piece or setting for an interchangeable ornament.

According to the present invention, a jewelry piece provides a body or housing, and a cover or back, that are coupled together. The jewelry piece also provides a locking mechanism housed within the body, where the locking mechanism includes a spring-loaded lever or arm mounted on a pivoting post. The body defines a cavity or recess for removably receiving an ornament. The cover includes a first mating element, and the locking mechanism includes a second mating element. When the jewelry piece is in a closed position, the first mating element and the second mating element mechanically engage.

In an embodiment, a jewelry piece for an interchangeable ornament includes a body that defines a cavity for removably receiving the ornament, and a cover having a first mating element, where the cover that is coupled to the body. The jewelry piece also provides a locking mechanism that is housed within the body. The locking mechanism has a second mating element and a spring-loaded lever mounted on a pivoting post. The first mating element and the second mating element mechanically engage when the jewelry piece is in a closed position.

In another embodiment, a jewelry piece for an ornament provides a housing defining a first cavity for receiving the ornament, where the housing is open at opposing ends, and where the housing has an open top end with a portion that abuts an upper portion of the ornament. When the ornament is received in the housing, a crown of the ornament is displayed in the open top of the housing. The jewelry piece also provides a cover having a first mating element, where the cover is coupled to an open bottom end of the housing so as to be moveable to a closed position, thus overlying at least a portion of the bottom end of the housing. The jewelry piece also provides a locking mechanism that is substantially contained in the housing and includes a lever mounted on a post. The lever includes a second mating element proximate a first opposing end of the lever, and a second opposing end of the lever is coupled to a spring. The first mating element and the second mating element disengage when the spring is compressed and the lever pivots on the post. The ornament is held in abutment against the housing top end when the first mating element and the second mating element are engaged and the cover is in the closed position.

In an aspect, the lever is mounted on the post proximate the center of the lever. The spring is compressed and the lever pivots on the post when the lever is depressed proximate the second opposing end of the lever.

In another aspect, the housing further includes a sidewall connecting the opposing ends of the housing, and the locking mechanism is substantially contained within a second cavity defined in the sidewall.

In an additional aspect, the spring is compressed and the lever pivots on the post when a portion of the lever extending beyond the second cavity is depressed.

In another aspect, the first cavity of the housing is sized and shaped to substantially conform to the size and the shape of the ornament.

In still another aspect, the bottom end of the body defines an opening sized and shaped to accept the cover first mating element when the cover is in the closed position.

In another aspect, the bottom end of the body defines a notch, and the cover defines a tab that overlays the notch when the cover is in the closed position.

In yet another aspect, the cover is open at opposing ends, and has an open top end with a portion that abuts a lower portion of the ornament when the ornament is received in the housing, so as to display a bottom of the ornament in the open bottom of the housing.

In an additional aspect, the housing and the cover are substantially annular, and the circumference of the bottom end of the housing is greater than the circumference of the cover.

In another aspect, the housing is coupled to the cover by a hinge, and the length of the hinge is less than the length of the housing and the width of the hinge is less than the width of the housing.

In still another aspect, a portion of the cover abuts a lower portion of the ornament when the cover is in the closed position.

In another aspect, the jewelry piece also includes a support member that is substantially contained in a channel defined in the cover, and a portion of the support member abuts a lower portion of the ornament when the cover is in the closed position.

In an additional aspect, the first mating element and the second mating element each include a hook.

In another aspect, the jewelry piece includes a bail.

In an additional embodiment, a setting for an ornament includes a body that defines a first void for removably receiving the ornament and includes a top, a bottom, and a perimeter wall connecting the top and the bottom. In addition, the top defines an opening. The setting also provides a back that is hingedly connected to the body and includes a back coupling member. The setting also provides a locking element that is substantially housed in a second void defined in the body perimeter wall, where the locking element includes an arm. A first end of the arm includes an arm coupling member, and a second end of the arm is connected to a spring. The setting is in a locked position when the back coupling member and the arm coupling member are coupled. The setting is moveable to an unlocked position when the spring is compressed and the arm pivots to decouple the back coupling member and the arm coupling member. A portion of the ornament is visible through the opening in the top of the body when the ornament is received in the body and the setting is in a locked position.

In an aspect, the arm pivots about an axis proximate the center of the arm.

In another aspect, at least a portion of the second end of the arm extends through an exterior surface of the perimeter wall when the setting is in a locked position.

In an additional aspect, the back coupling member is not visible from the exterior of the setting when the setting is in a locked position.

In another aspect, a portion of a crown of the ornament is in contact with a portion of the body, and a portion of a bottom of the ornament is in contact with a portion of the back, when the setting is in a locked position.

In an additional embodiment, a setting for an interchangeable ornament provides a housing that defines a first cavity for receiving the ornament. The housing is open at opposing ends, and has an open top end with a portion that abuts an upper portion of the ornament. When the ornament is received in the housing, a crown of the ornament is displayed in the open top of the housing. The setting also provides a cover that includes a cover mating element. The cover is hingedly coupled to an open bottom end of the housing so as to be moveable to a closed position overlying at least a portion of the bottom end of the housing. The setting also provides a locking mechanism that is substantially contained in a second cavity defined in a sidewall of the housing. The sidewall connects the top end and the bottom end of the housing. The locking member includes a lever that has a lever mating element proximate a first end of the lever. A second end of the lever is coupled to a spring, and at least a portion of the lever extends through an exterior surface of the sidewall when the cover is in the closed position. The cover mating element and the lever mating element disengage when the spring is compressed and the lever pivots about an axis proximate the center of the lever. The ornament is held in abutment against the housing top end when the cover mating element and the lever mating element are engaged.

Although the present invention is described and illustrated herein as being implemented with a pendant, the embodiments described herein are provided as examples and are not limitations. As those skilled in the art will appreciate, the present invention may be applied with a variety of different types of jewelry pieces and with different types of ornaments.

BRIEF DESCRIPTION OF THE SEVERAL VIEWS OF THE DRAWINGS

The foregoing and other features and advantages will be apparent from the following more particular description of exemplary embodiments of the disclosure, as illustrated in the accompanying drawings, in which like reference characters refer to the same parts throughout the different views. The drawings are not necessarily to scale, emphasis instead being placed upon illustrating the principles of the disclosure.

DETAILED DESCRIPTION OF THE INVENTION

Figure 1:
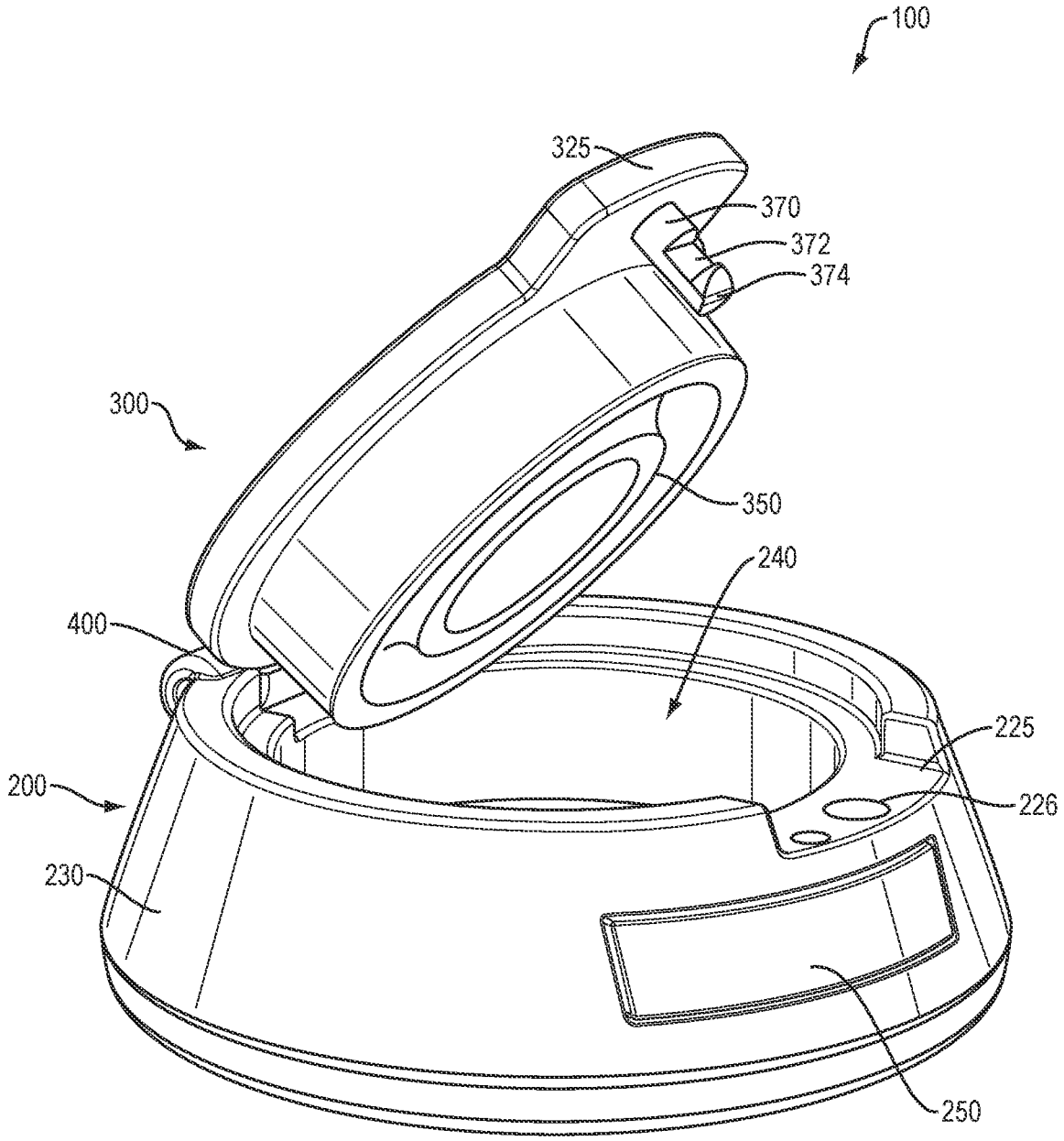
FIG. 1 is a perspective view of a jewelry piece for an interchangeable ornament in a partially open position, in accordance with a preferred embodiment of the invention.
Figure 2:
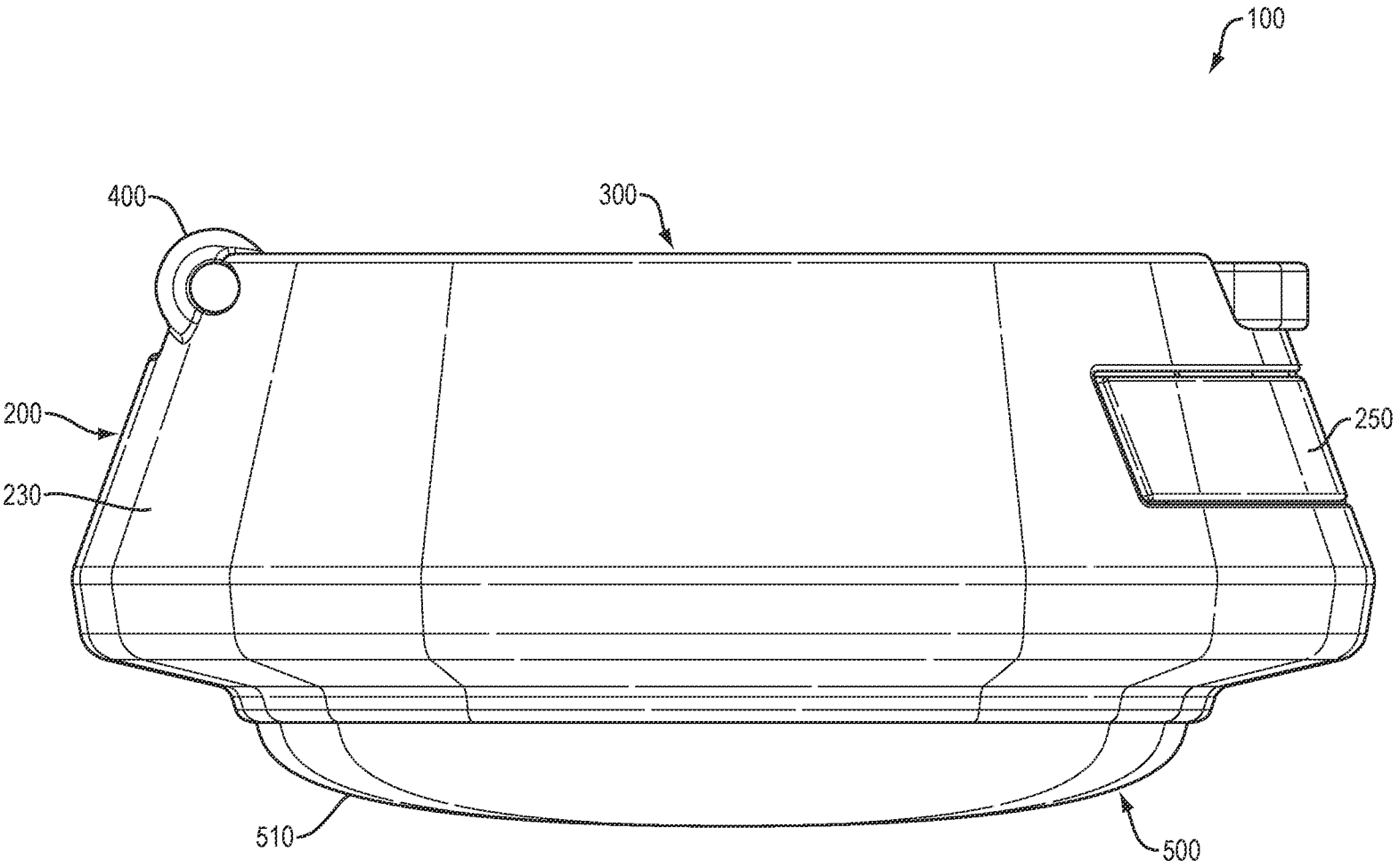
FIG. 2 is a first side view of the jewelry piece of FIG. 1 in a closed position, with the addition of an exemplary ornament.
Figure 3:
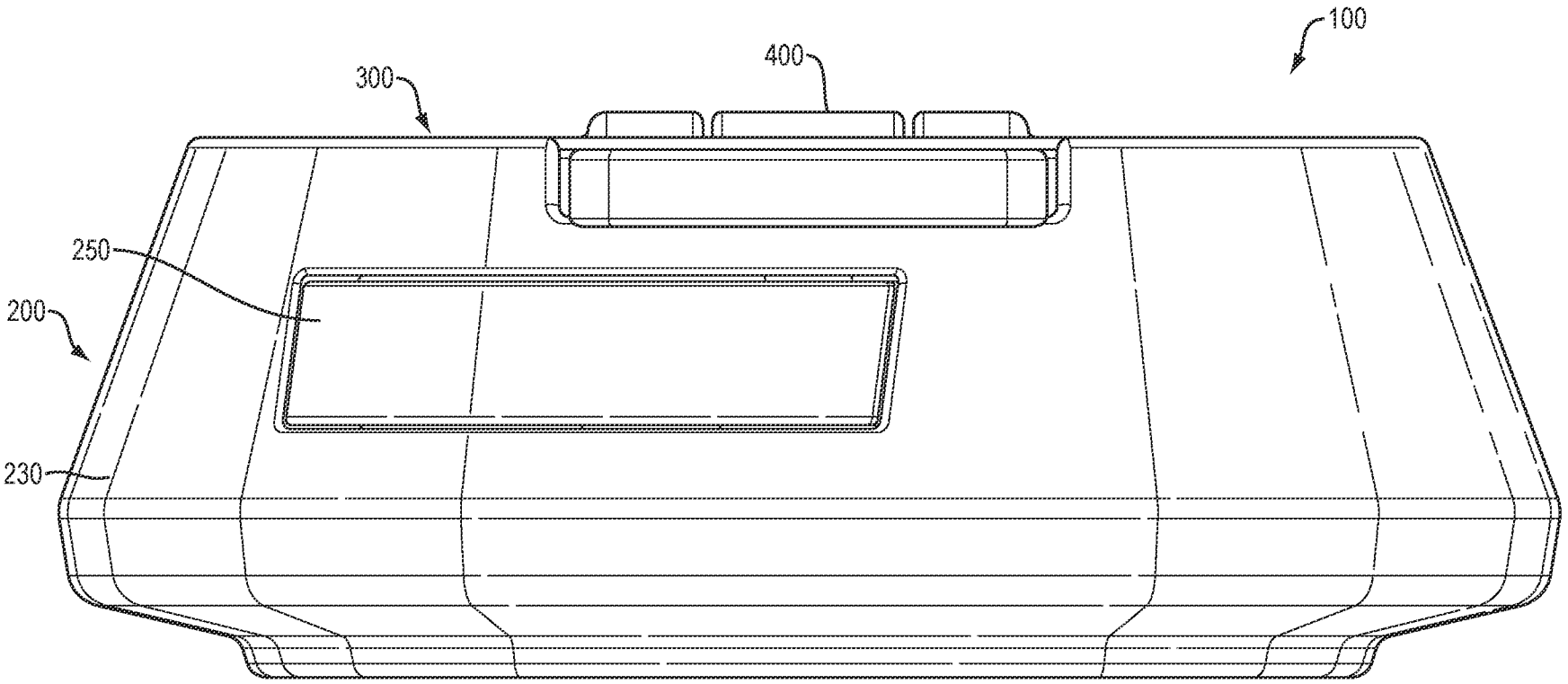
FIG. 3 is a second side view of the jewelry piece of FIG. 1 in a closed position.
Figure 4:
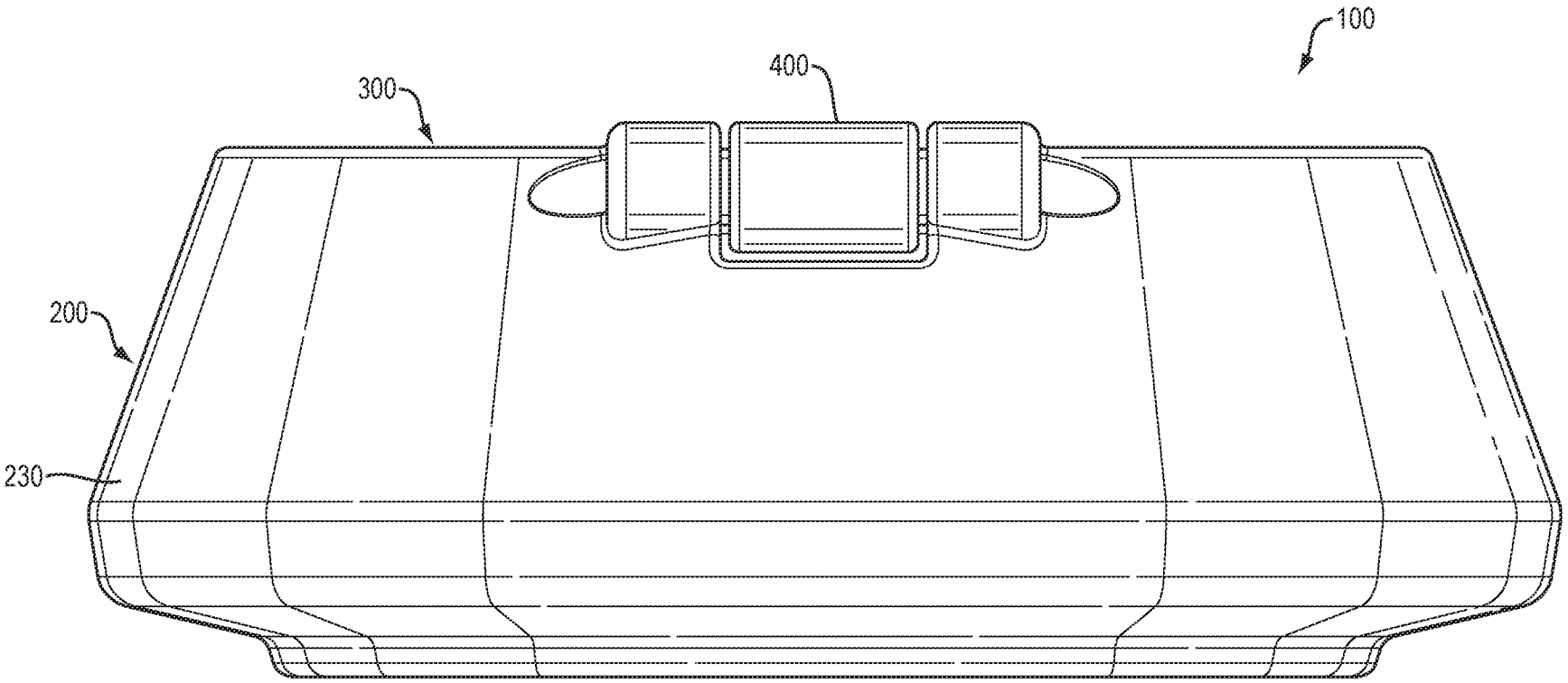
FIG. 4 is a third side view of the jewelry piece of FIG. 1 in a closed position.

With reference to FIGS. 1-15, in a preferred embodiment, jewelry piece 100, shown as a substantially round pendant, comprises two sections: a body or housing 200 and a cover or back 300. The body 200 is coupled to the cover 300 by a hinge 400, enabling jewelry piece 100 to open and close with limited rotational movement.

Note that the jewelry piece of the invention is not limited to a pendant. In additional embodiments, the jewelry piece 100 may include, but is not limited to, a necklace, bracelet, earrings, brooch, pin, or watch. Note also that the jewelry piece 100 is not limited to a round shape. In additional embodiments, the jewelry piece 100 may be substantially any shape, and is not limited by the shape of the ornament 500.

In preferred embodiments, jewelry piece 100 is primarily composed of formable precious metals, such as gold or silver. In additional embodiments, jewelry piece 100 may be formed of other precious metals including but not limited to platinum; base metals, including but not limited to copper, tin, or zinc; stainless steel; metal alloys; plastics; bone, or other non-precious metals. Jewelry piece 100 is preferably manufactured by casting, but may also be manufactured by machining, soldering, die striking or a combination thereof, or may be formed by hand, or any other suitable method of manufacture or production.

As shown in FIGS. 1-6, the jewelry piece body 200 is preferably substantially annular and comprises a top surface 210, a bottom surface 220, and a contiguous sidewall 230 that connects the top surface 210 to the bottom surface 220. The body 200 further defines an internal space or cavity 240 for removably receiving an ornament 500. Body cavity 240 is preferably adapted and configured to substantially conform to the size and shape of the ornament 500, and thus firmly secure the ornament 500 and prevent it from rattling in the body cavity 240 when the jewelry piece 100 is closed, as further described below. In additional embodiments, jewelry piece body 200 and body cavity 240 may be substantially any suitable shape or size.

In a preferred embodiment, ornament 500 is a gem stone. In additional embodiments, the ornament 500 may include, but is not limited to, a precious stone, semi-precious stone, imitation stone, coin, and other small token. Note also that the shape of the ornament 500 may be substantially any shape, including but not limited to marquis, round, trillion, oval, pear or tear drop, square, octagon, emerald, baguette, antique cushion, heart-shape, briolette cabochon, faceted, and princess cut. In addition, the ornament 500 may be substantially any material, including but not limited to diamond, ruby, sapphire, or any other precious or semi-precious jewelry stone, glass, crystal, pearl, mother-of-pearl, man-made stones, simulated stones, and laboratory-created stones. There are no restrictions on the size of the ornament 500. In the example jewelry piece shown in FIGS. 1-15, a substantially round pendant, the diameter of ornament 500 is preferably 10 or 12 millimeters.

Figure 5:
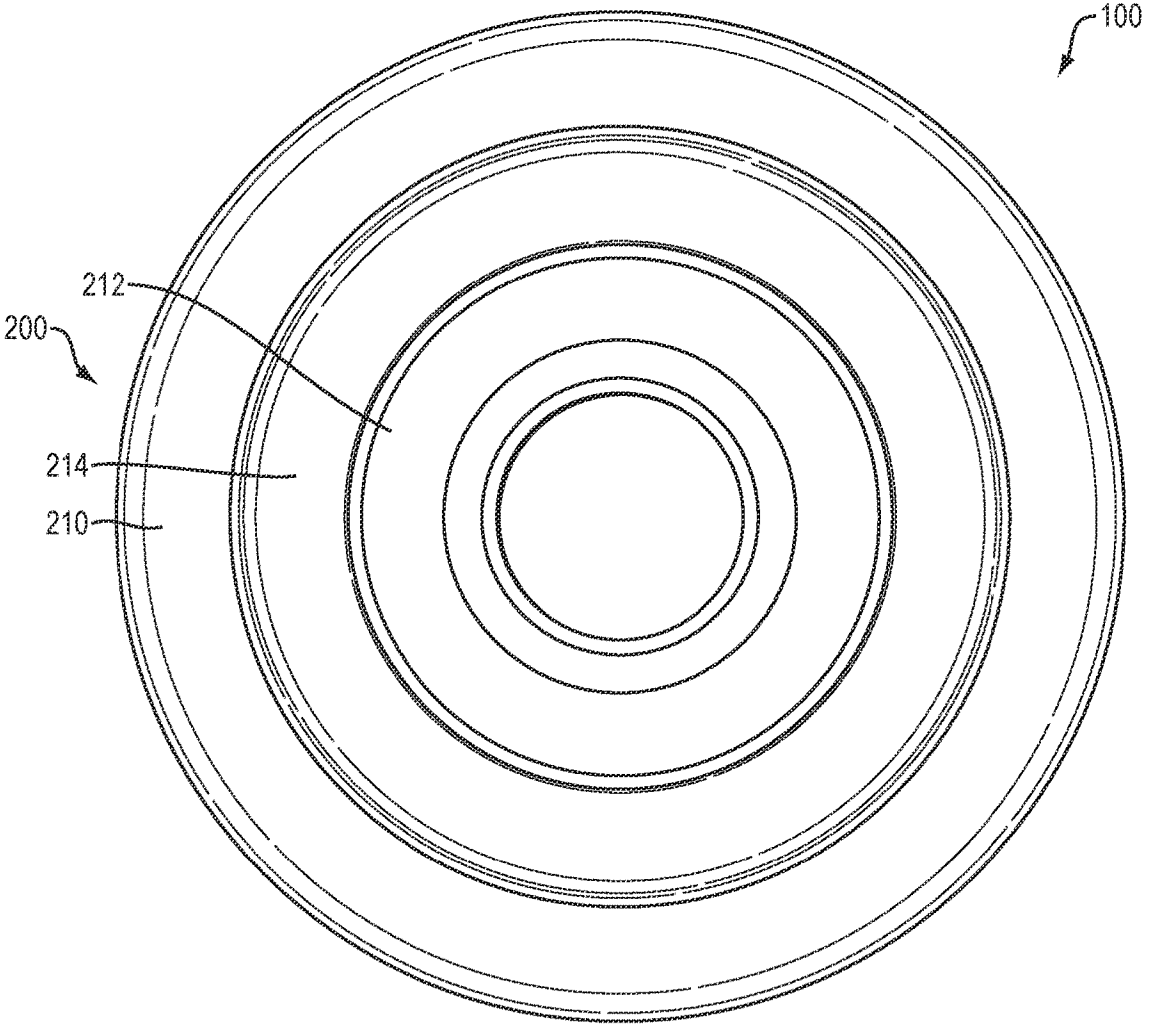
FIG. 5 is a front view of the jewelry piece of FIG. 1 in a closed position.

In a preferred embodiment, and with further reference to FIG. 5, the top surface 210 of the body 200 defines a first opening 212 and a rim 214 that extends substantially circumferentially around the first opening 212. With further reference to FIGS. 1, 2, 5, 13, and 15, the bottom surface 220 of the body 200 defines a second opening 222 and a notch or cut-out 225. The body notch 225 further defines an opening 226 adapted and configured to accept the cover protruding post 370, described below. The ornament 500 is inserted into the body cavity 240 through the second opening 222 in the bottom surface 220, such that the top or crown 510 of the ornament 500 abuts and may be viewed through the first opening 212 in the top surface 210. The rim 214 of the top surface 210 contacts with at least a portion of the top or crown 510 of the ornament 500, and is adapted and configured to prevent the ornament 500 from falling out of the body cavity 240 through the first opening 212 in the top surface 210.

Note that the body top surface 210 may optionally comprise decorative treatments, including but not limited to etching or embossing, or adding decorative chains or stones. In an additional embodiment, top surface 210 may include a channel or groove that may be used to hold decorative objects, such as a chain or small stones. In another embodiment, rim 214 and top surface 210 may be on the same horizontal plane, forming a substantially flat surface.

Figure 12:
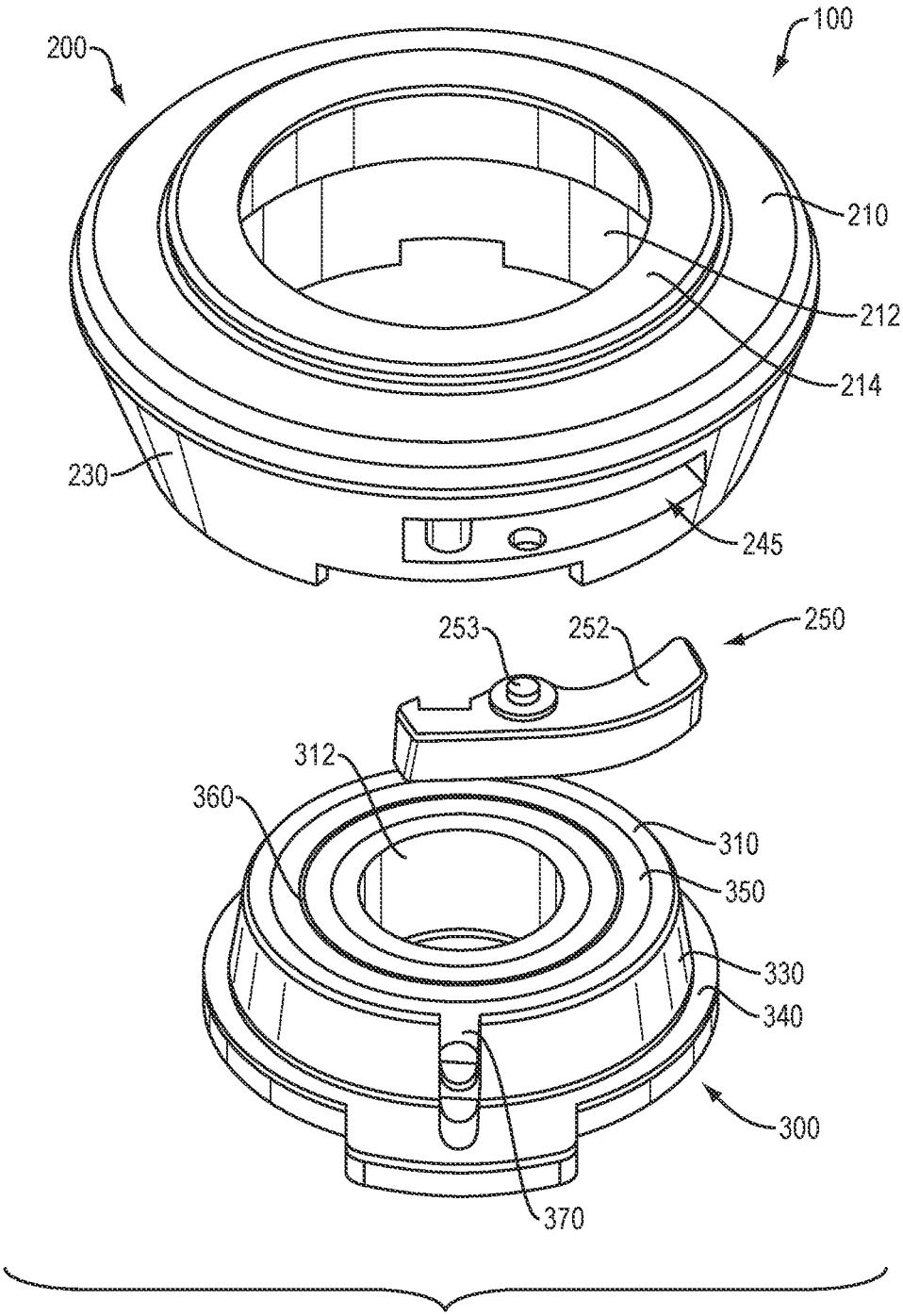
FIG. 12 is a first exploded view of the jewelry piece of FIG. 1.
Figure 13:
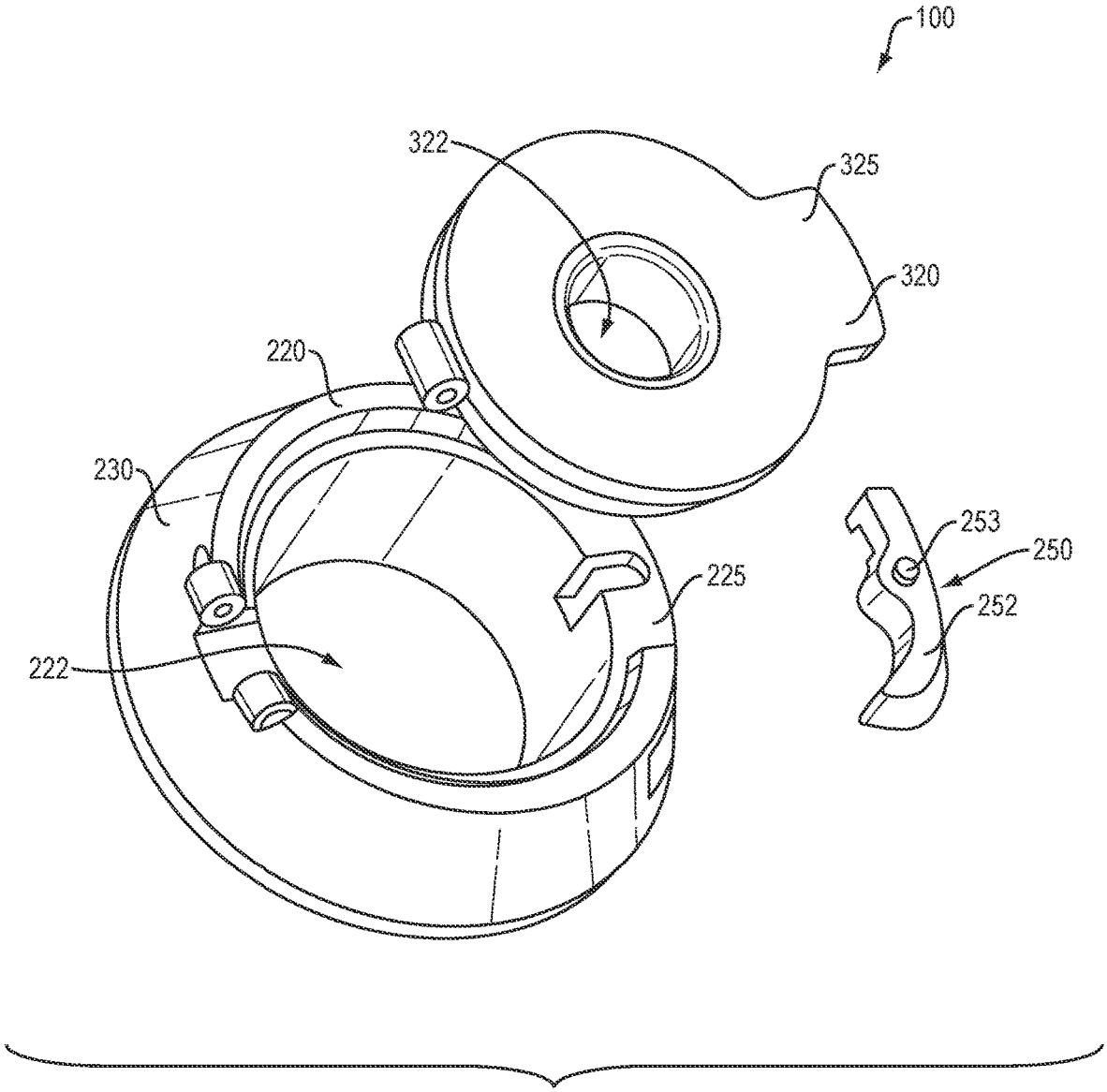
FIG. 13 is a second exploded view of the jewelry piece of FIG. 1.
Figure 14:
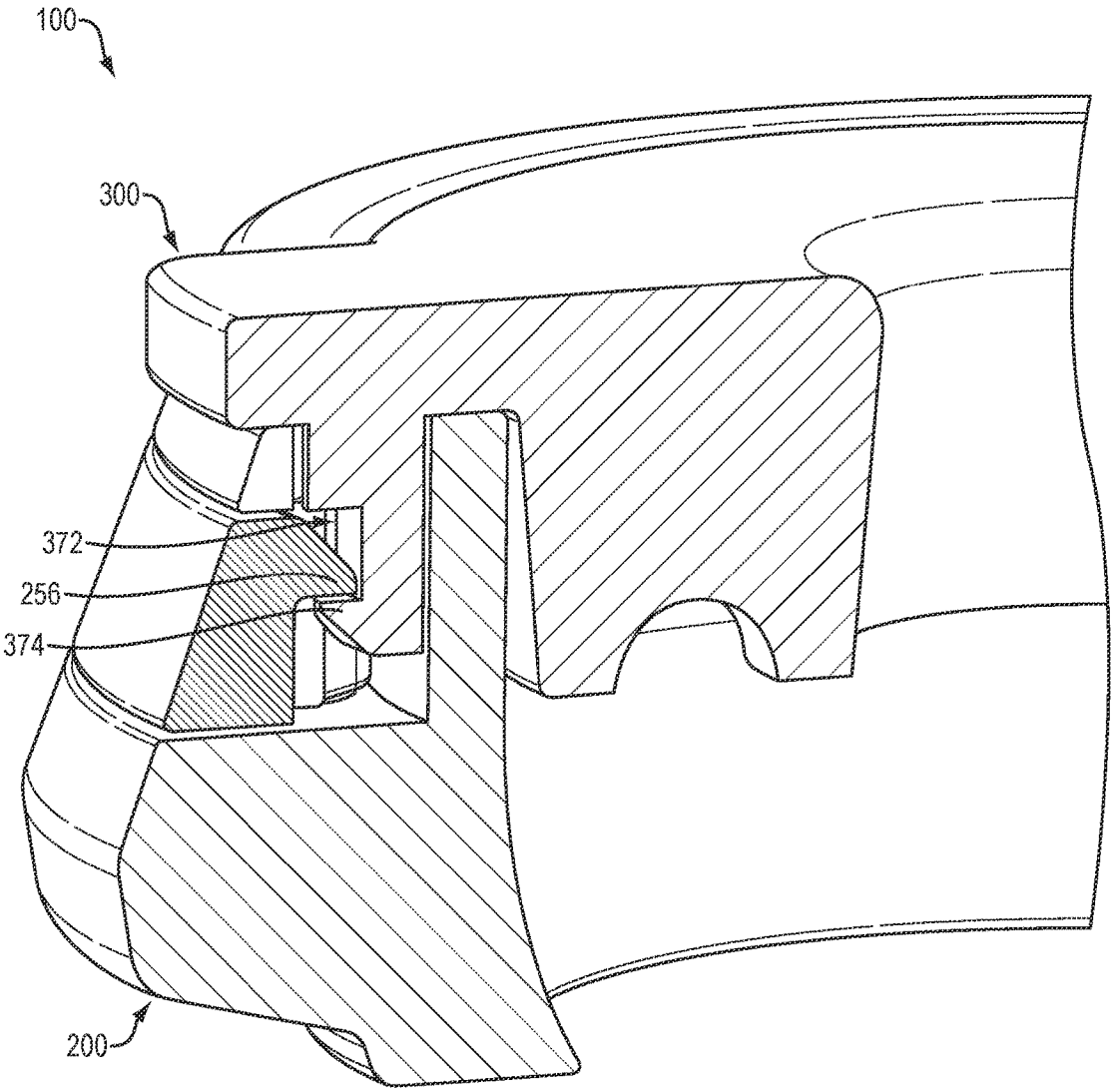
FIG. 14 is a cut-away view of the jewelry piece of FIG. 1, showing a portion of the locking mechanism.

In a preferred embodiment, and with further reference to FIGS. 1, 12 and 13, the cover 300 is substantially annular and comprises a top surface 310, a bottom surface 320, a contiguous sidewall 330 connecting the top surface 310 and the bottom surface 320, a lip 340 and a tab or protrusion 325. The lip 340 is substantially perpendicular to the sidewall 330 and is adapted and configured to contact the bottom surface 220 of the body 200 when the jewelry piece 100 is closed.

With further reference to FIGS. 1, 5, 6, and 15, cover 300 is preferably adapted and configured such that it is not visible when the jewelry piece 100 is viewed from the front or the side, to minimize exterior evidence of the interchangeability of the ornament 500. In a preferred embodiment, and as shown in FIG. 13, cover bottom surface 320 has a circumference that is smaller than the circumference of body bottom surface 220.

Figure 6:
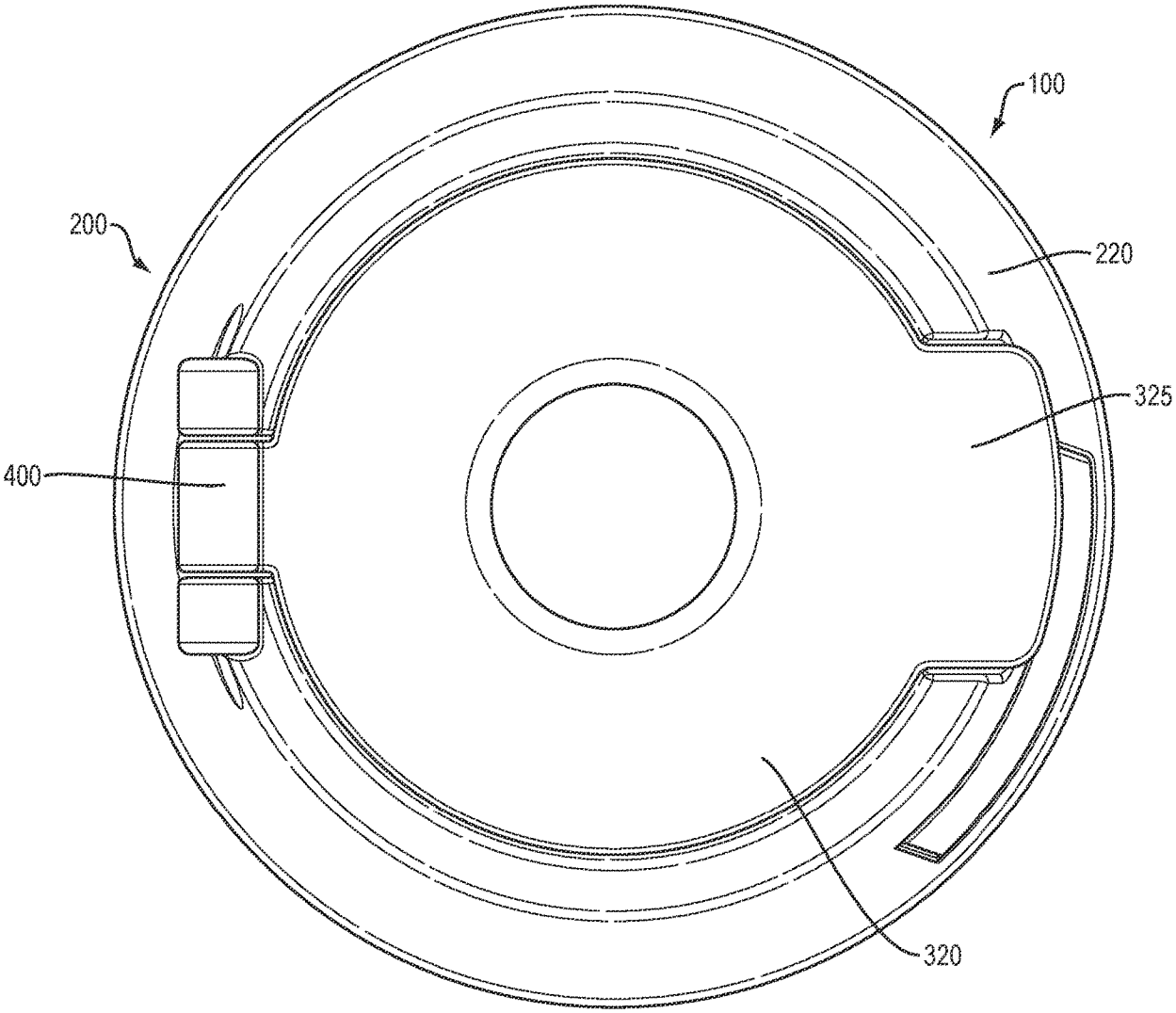
FIG. 6 is a back view of the jewelry piece of FIG. 1 in a closed position.
Figure 7:
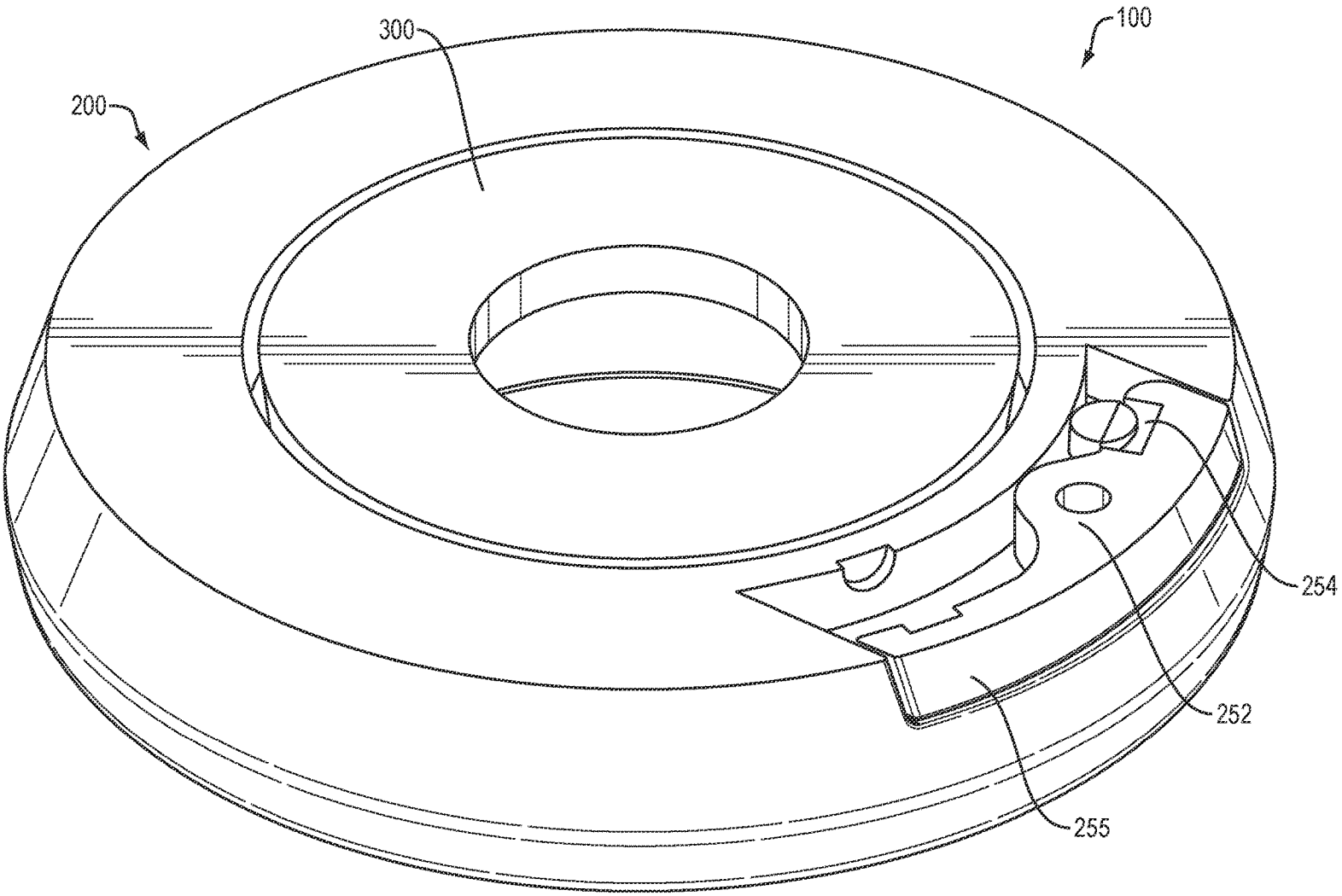
FIG. 7 is a first perspective view of the jewelry piece of FIG. 1, with parts of the body and the cover removed to show a portion of the locking mechanism.

In a preferred embodiment, and as shown in FIGS. 6, 12 and 13, the top surface 310 of the cover 300 defines a first opening 312. The bottom surface 320 of the cover 300 defines a second opening 322. The first opening 312 and the second opening 322 are adapted and configured to allow light to enter the body cavity 240. If the ornament 500 is sufficiently translucent, openings 312 and 322 are adapted and configured to allow light to pass through the ornament.

In alternate embodiments, the second opening 322 in the cover 300 may be eliminated, and the cover bottom surface 320 may be a continuous planar surface. This alternate embodiment may be used, for example, when the ornament 500 is not sufficiently translucent to allow light to pass.

Figure 15:
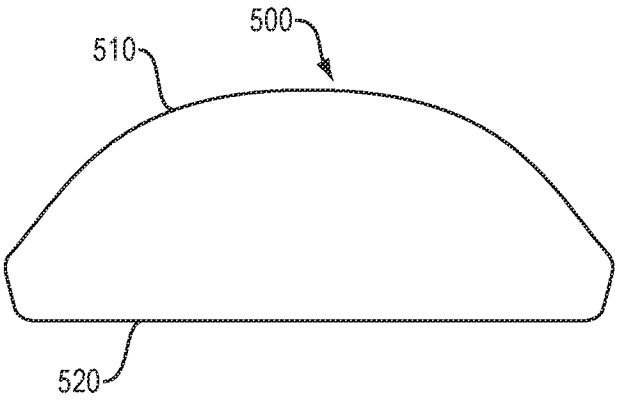
FIG. 15 is a side view of the exemplary ornament of FIG. 2.

In a preferred embodiment, and as shown in FIGS. 1, 12, and 15, the cover 300 further defines a groove or channel 350 that extends substantially circumferentially around the first opening 312 of the top surface 310. A support member 360 substantially fills the channel 350 and protrudes slightly above the horizontal plane of top surface 310. Support member 360 is adapted and configured to contact the bottom 520 of the ornament 500 when jewelry piece 100 is closed, and push the ornament 500 against the top surface rim 214 to secure the ornament 500 in the body cavity 240. Support member 360 is preferably made of silicone, to prevent scratching or otherwise damaging the ornament 500 and clear silicone is preferred for aesthetic reasons. In alternate embodiments, support member 360 may be made of any compressible material that functions to hold the ornament in place, such as rubber. In other embodiments, support member 360 may be eliminated, such that cover 300 is in direct contact with the bottom 520 of the ornament, functioning to secure the ornament 500 in the body cavity 240. In additional embodiments, channel 350 may be eliminated, such that the cover top surface 310 defines a substantially flat surface, and where support member 360, if used, is placed directly on the cover top surface 310.

In a preferred embodiment, and as shown in FIGS. 1, 11-14, the cover 300 further comprises a protruding post or functionally similar protuberance 370 that is substantially perpendicular to the top surface 310 of the cover 300. Protruding post 370 defines a cut-out or notch 372 and a first mating element, shown by way of example as a hook 374 that engages with a second mating element, also shown by way of example as a hook 256 in the locking mechanism 250, as described below. Protruding post 370 is contained in the body notch opening 226 when the jewelry piece is closed, as described below.

Figure 9:
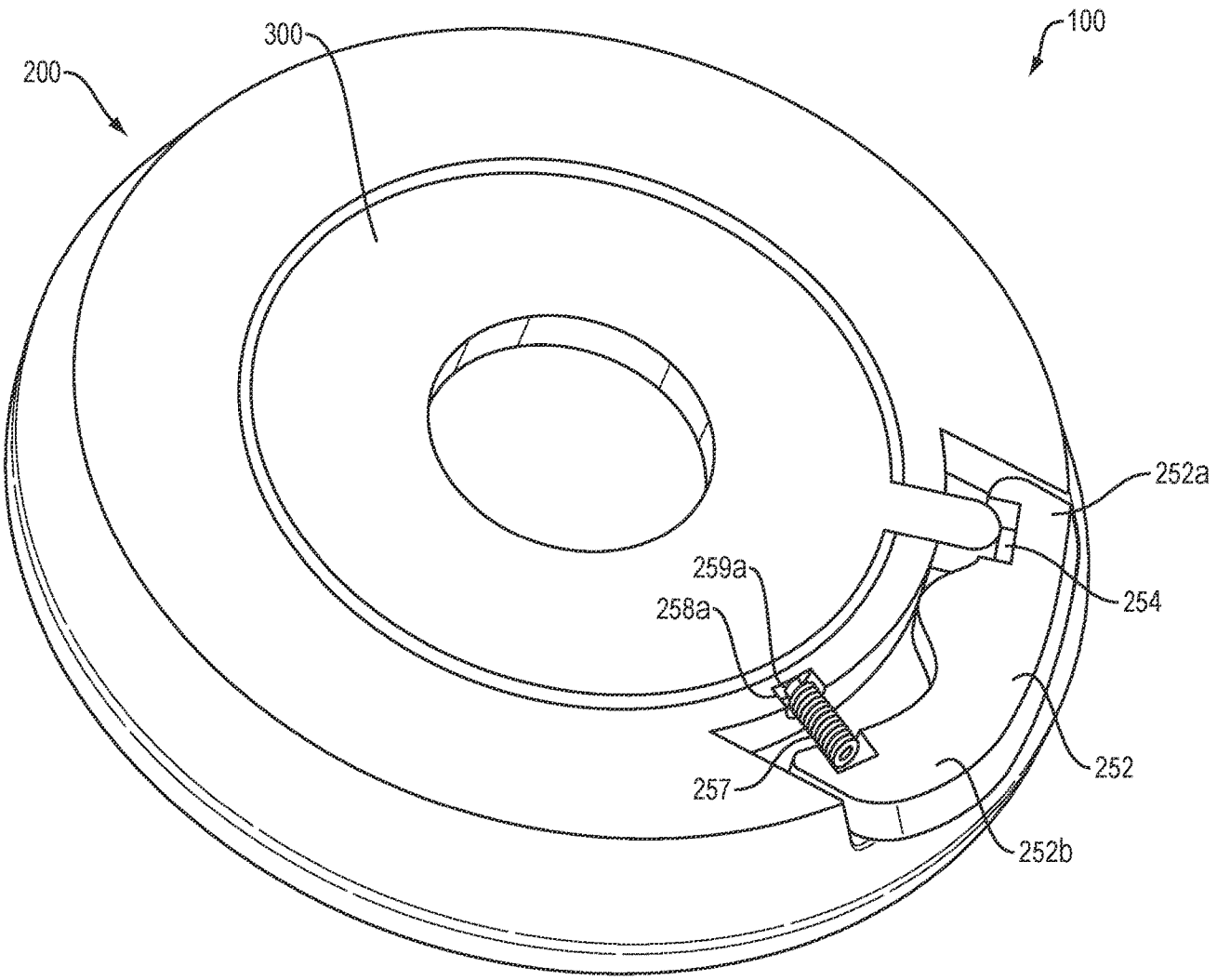
FIG. 9 is a third perspective view of the jewelry piece of FIG. 1, with parts of the body and the cover removed to show a second embodiment of a portion of the locking mechanism.
Figure 10:
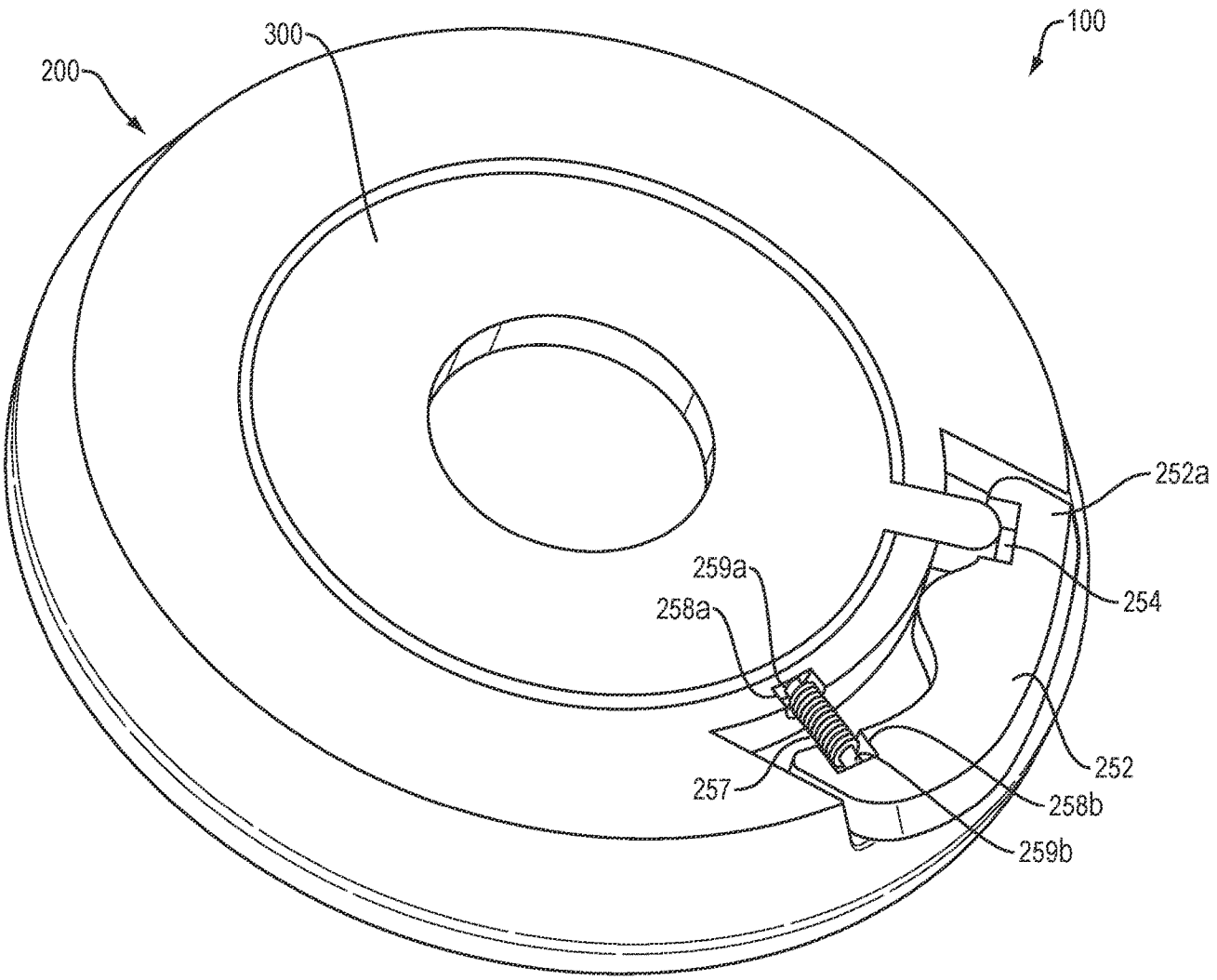
FIG. 10 is a fourth perspective view of the jewelry piece of FIG. 1, with parts of the body and the cover removed to show a third embodiment of a portion of the locking mechanism.
Figure 11:
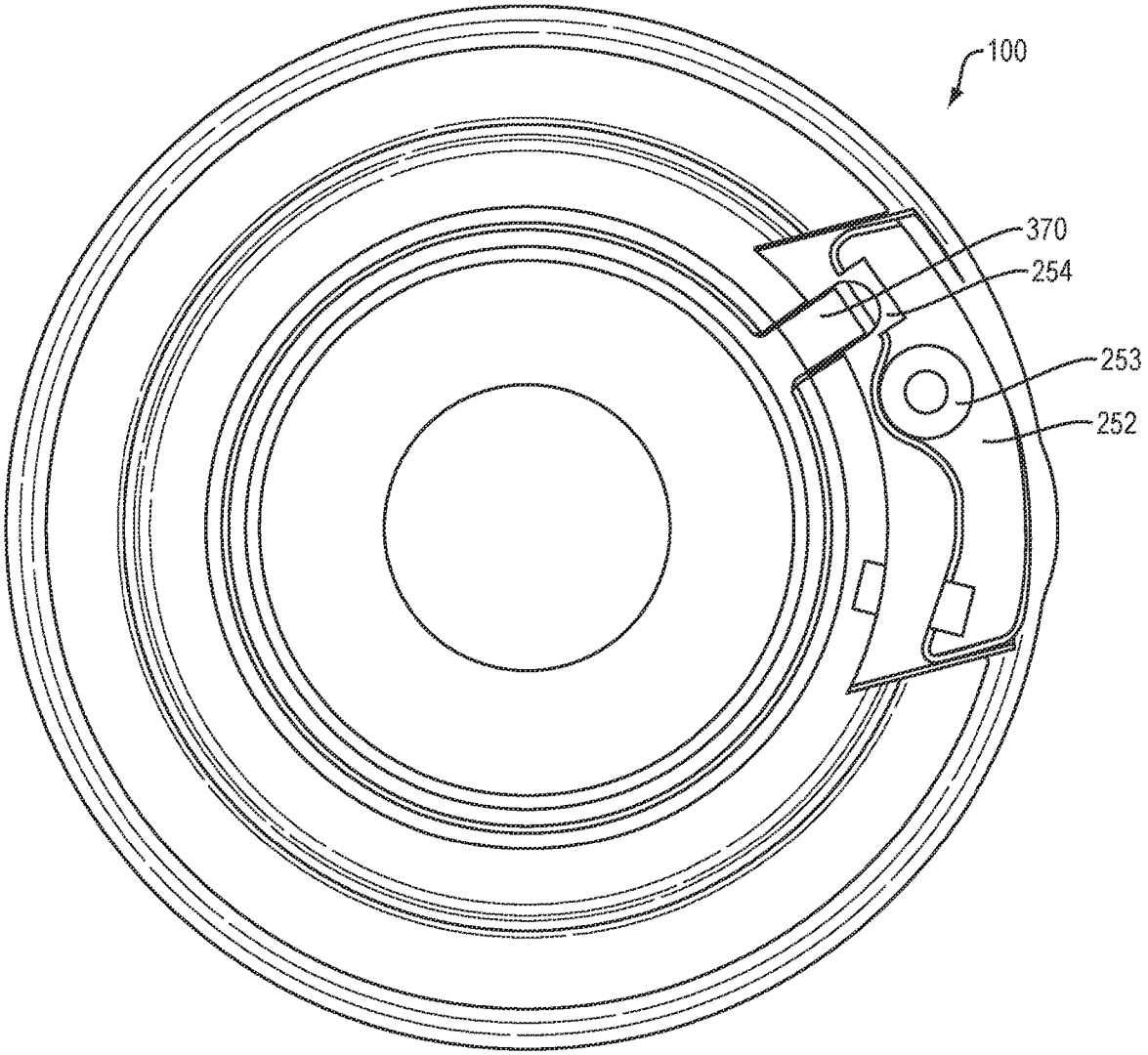
FIG. 11 is a front view of the jewelry piece of FIG. 1, with parts of the body and the cover removed to show a portion of the locking mechanism.

In a preferred embodiment, and as shown in FIGS. 1 and 7-12, jewelry piece 100 further comprises a locking mechanism 250 that is adapted and configured to secure the ornament 500 when the jewelry piece 100 is closed. Locking mechanism 250 is substantially housed within a locking mechanism cavity 245 in the body 200, preferably located opposite the hinge 400. Locking mechanism 250 comprises a spring-loaded lever 252 mounted on a pivoting post or functionally similar protrusion or protuberance 253 that extends substantially perpendicular to a horizontal plane of lever 252, as shown in FIG. 11. As described below, lever 252 pivots about the post 253.

In a preferred embodiment, and as shown in FIGS. 7-14, lever 252 defines two substantially opposing ends **252*a* and 252*b*, and a sidewall 255. Lever 252 is preferably mounted on post 253 proximate the center of the lever 252, between the two opposing ends 252*a* and 252*b*. The first end 252*a* of the lever 252 defines a cut-out or notch 254 and comprises a mating element, shown by way of example as a hook 256. The lever hook 256 is adapted and configured to engage the cover hook 374 when the jewelry piece 100 is closed. The second end 252*b* of the lever 252 is coupled to a spring 257. The lever sidewall 255 extends through an opening in the body sidewall 230, and the spring end 252*b* of the lever sidewall 255 protrudes slightly beyond the plane of the body sidewall 230. The remainder of the locking mechanism 250, including the post 253 and the spring 257, is preferably fully enclosed in the body 200, within the body locking mechanism cavity 245. The placement of the locking mechanism 250 substantially in the body 200 is designed to minimize exterior evidence of the interchangeability of the ornament 500**.

When the protruding spring end **252*b* of the lever sidewall 255 is depressed, the spring 257 is compressed, the lever 252 pivots on the pivoting post 253, and the hook end 252*a* of the lever 252 is pushed outward and away from the body sidewall 230. As shown in FIGS. 7-14, this movement disengages the lever hook mating element 256 from the cover hook mating element 374 to decouple the cover 300 from the body 200, opening the jewelry piece 100**.

The jewelry piece 100 is closed by depressing the protruding spring end **252*b* of the lever sidewall 255, such that the lever 252 pivots on the pivoting post 253, and the hook end 252*a* of the lever 252 is pushed outward and away from the body sidewall 230. The cover 300 can then be coupled with the body 200, such that the cover hook mating element 374 engages with the lever hook mating element 256, and the spring is extended, when the protruding spring end 252*b* of the lever sidewall 255** is released.

Figure 8:
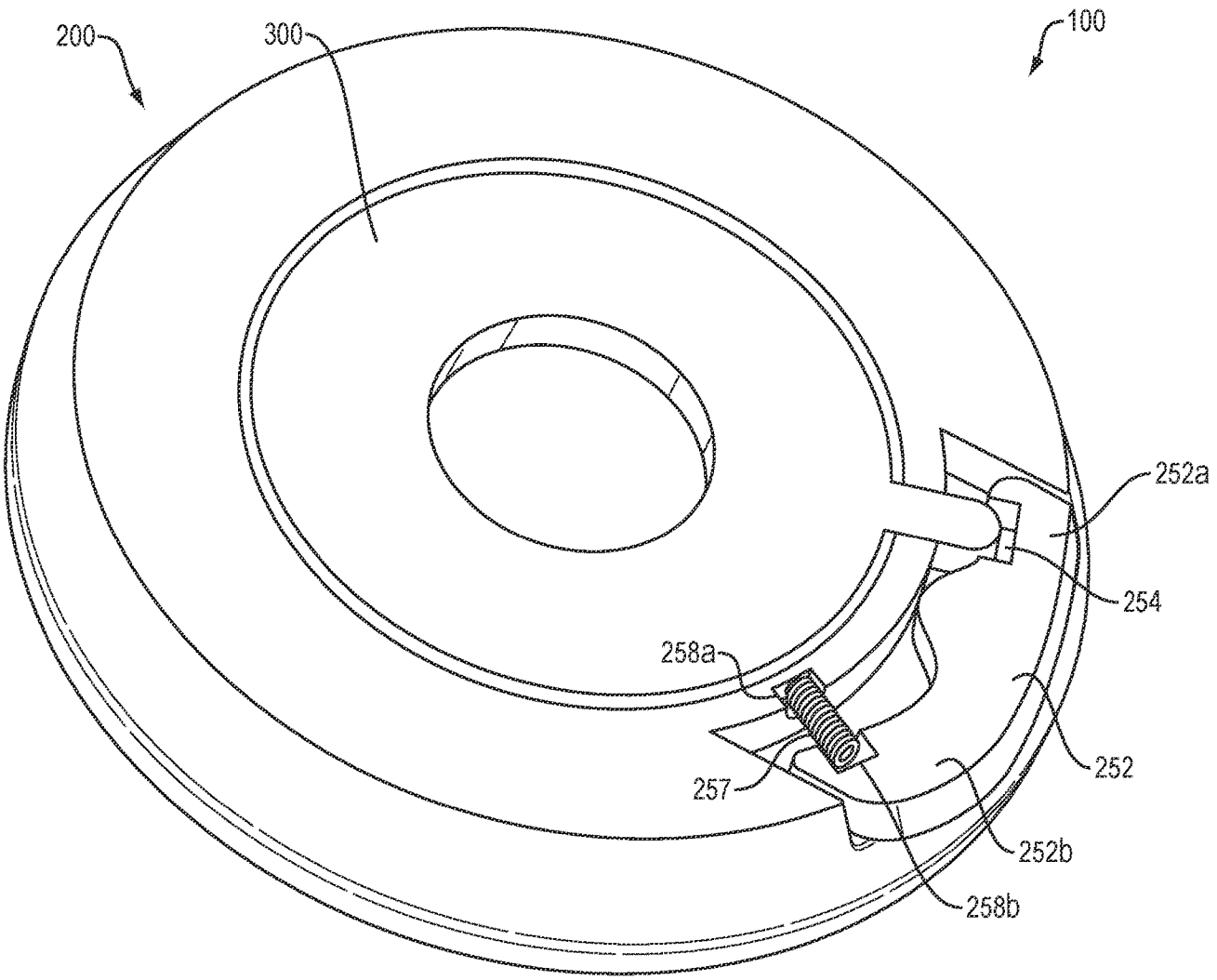
FIG. 8 is a second perspective view of the jewelry piece of FIG. 1, with parts of the body and the cover removed to show a first embodiment of a portion of the locking mechanism.

As shown in FIG. 8, the opposing ends of spring 257 are positioned within notches or cut-outs **258*a* and 258*b*. In a preferred embodiment, and as shown in FIG. 9, one of the opposing ends of spring 257 are supported by a peg or post or functionally similar protuberance 259*a*, located in notch 258*a*. Post 259*a* extends partially through the interior of spring 257 and is used to keep spring 257 rigid. In an additional preferred embodiment, and as shown in FIG. 10, both of the opposing ends of spring 257 are supported by peg or posts of functionally similar protuberance 259*a* and 259*b*, located in notches 258*a* and 258*b***, respectively.

In addition, the bottom surface 220 of the cover 200 is adapted and configured to cover the protruding post 370 so that it is not visible when the jewelry piece 100 is closed. Specifically, and as shown in FIGS. 1 and 6, when the jewelry piece is closed, cover tab 325 fits into body notch 225.

As shown in FIGS. 1, 2, 4, and 6, hinge 400 is preferably a barrel hinge. In alternate embodiments, hinge 400 may be a spring hinge, cylindrical hinge, or any other suitable hinge or closure that allows jewelry piece 100 to open and close. With reference to FIG. 6, hinge 400 is adapted and configured to minimize exterior evidence of the interchangeability of the ornament 500, and is not visible from the front of the jewelry piece 100. In a preferred embodiment, when coupled to both the cover bottom surface 320 and the body bottom surface 220, the length and width of hinge 400 do not exceed the circumference of body bottom surface 220. In alternate embodiments, if the cover 300 and body 200 are not substantially annular, the length and width of hinge 400 preferably do not exceed the length and the width of the body bottom surface 200.

Figure 16:
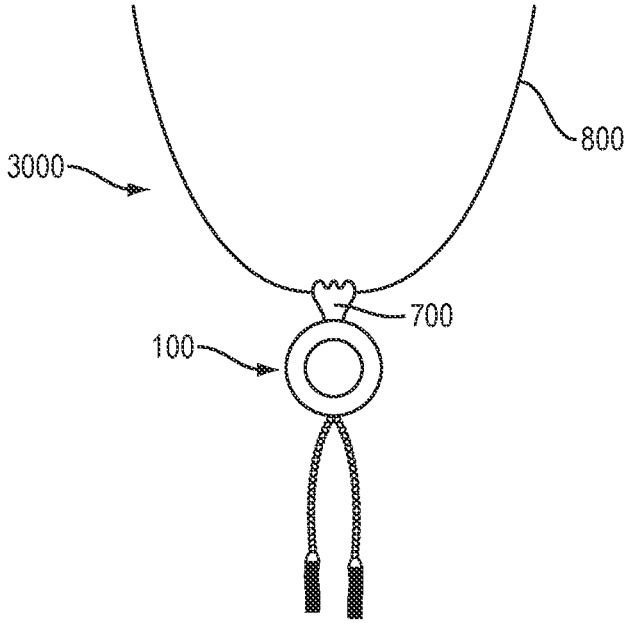
FIG. 16 is a front view of a jewelry piece, shown as a pendant for an interchangeable ornament, in accordance with a first additional embodiment of the invention.

As shown in FIG. 16, and with further reference to FIGS. 1-6, in an additional embodiment, jewelry piece 100 may further comprise a bail 700, preferably located proximate the top of the jewelry piece 100 and longitudinally opposite the hinge 400. The bail 700 defines an opening that is adapted and configured to allow a chain or cord 800 to be inserted, to form a pendant necklace 3000.

Figure 17:
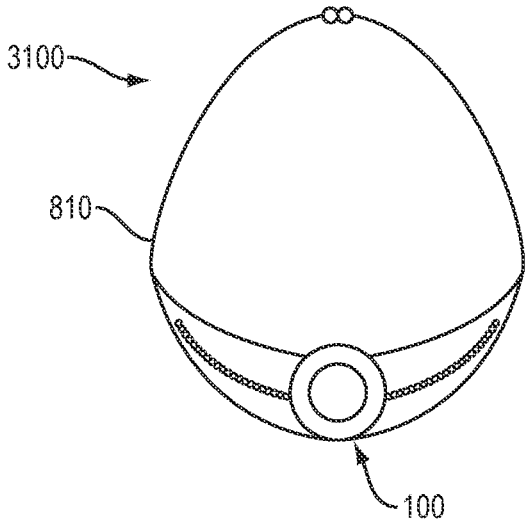
FIG. 17 is a front view of a jewelry piece, shown as a necklace for an interchangeable ornament, in accordance with a second additional embodiment of the invention.

In an additional embodiment shown in FIG. 17, and with further reference to FIGS. 1-6, jewelry piece 100 may be used with a chain, cord, or string of beads or other decorative elements 810, or any other suitable materials, to form necklace 3100. In this embodiment, bail 700 is optional and not required.

Figure 18:
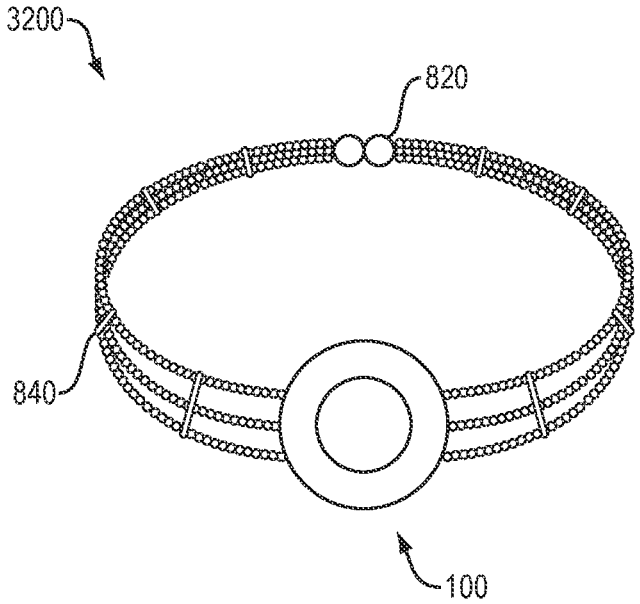
FIG. 18 is a perspective view of a jewelry piece, shown as a bracelet for an interchangeable ornament, in accordance with a third additional embodiment of the invention.

In an additional embodiment shown in FIG. 18, jewelry piece 100 may be used with a short chain, cord, or string of beads or other decorative elements 840 and clasp 820, or any other suitable materials, to form a bracelet 3200. In this embodiment, bail 700 is optional and not required.

Figure 19:
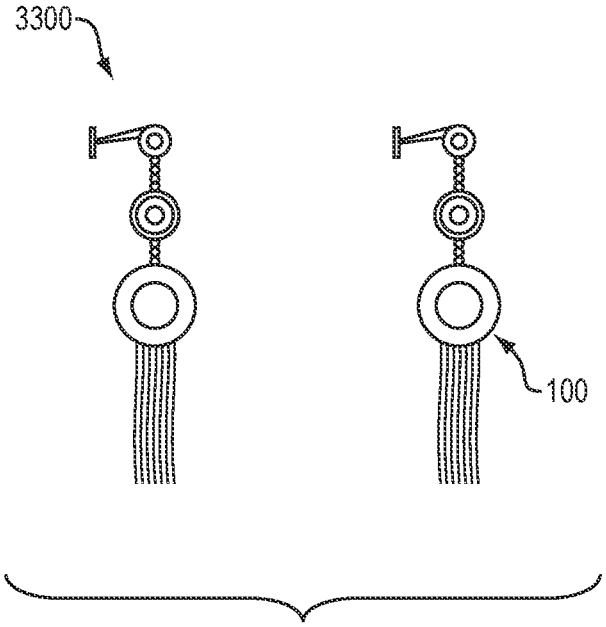
FIG. 19 is a front view of a jewelry piece, shown as earrings for an interchangeable ornament, in accordance with a fourth additional embodiment of the invention.

In another embodiment shown in FIG. 19, jewelry piece 100 may be used to form earrings 3300. In this embodiment, bail 700 is optional and not required.

With reference to FIGS. 16-19, and in another embodiment, the jewelry pieces of the invention may be part of a collection of jewelry pieces adapted and configured to accept the same interchangeable ornament. For example, necklace 3100 and bracelet 3200 may accept the same size and shape ornament, or set of ornaments of different materials or colors. Further, two or more of the jewelry pieces in a collection may be worn at the same time, with each jewelry piece having a matching ornament, or with the jewelry pieces having coordinating or complementary ornaments. For example, pendant necklace 3000 may be worn together with earrings 3300, with pendant necklace 3000 having a diamond ornament and earrings having coordinating ruby ornaments, or with both pendant necklace 3000 and earrings 3300 having matching sapphire ornaments. Note that all of these embodiments may include additional adornments, including but not limited to etching, embossing, tassels, chains, and decorative stones or beads.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A jewelry piece for an ornament, the jewelry piece comprising:

a housing defining a first cavity for receiving the ornament, the housing open at opposing ends with an open top end having a portion that abuts an upper portion of the ornament when the ornament is received in the housing so as to display a crown of the ornament in an open top of the housing;

a cover comprising a first mating element, the cover coupled to an open bottom end of the housing to be moveable to a closed position overlying at least a portion of a bottom end of the housing;

a locking mechanism substantially contained in the housing and comprising a lever mounted on a post, the lever comprising a second mating element proximate a first opposing end of the lever, and a second opposing end of the lever is coupled to a spring;

where the first mating element and the second mating element disengage when the spring is compressed and the lever pivots on the post; and where the ornament is held in abutment against the portion that abuts the upper portion of the ornament when the first mating element and the second mating element are engaged and the cover is in the closed position.

2. The jewelry piece of claim 1, the lever mounted on the post proximate a center of the lever, and the spring is compressed and the lever pivots on the post when the lever is depressed proximate the second opposing end of the lever.

3. The jewelry piece of claim 1, the housing further comprising a sidewall connecting the opposing ends of the housing, and the locking mechanism substantially contained within a second cavity defined in the sidewall.

4. The jewelry piece of claim 3, where the spring is compressed and the lever pivots on the post when a portion of the lever extending beyond the second cavity is depressed.

5. The jewelry piece of claim 1, where the first cavity of the housing is sized and shaped to substantially conform to a size and a shape of the ornament.

6. The jewelry piece of claim 1, where the bottom end of the housing defines an opening sized and shaped to accept the first mating element when the cover is in the closed position.

7. The jewelry piece of claim 1, the bottom end of the housing defining a notch, and the cover defining a tab that overlays the notch when the cover is in the closed position.

8. The jewelry piece of claim 1, the cover open at opposing ends, with an open top end having a portion that abuts a lower portion of the ornament when the ornament is received in the housing so as to display a portion of the ornament in an open bottom of the cover.

9. The jewelry piece of claim 1, where the housing and the cover are substantially annular, and a circumference of the bottom end of the housing is greater than a circumference of the cover.

10. The jewelry piece of claim 1, where the housing is coupled to the cover by a hinge, and a length of the hinge is less than a length of the housing and a width of the hinge is less than a width of the housing.

11. The jewelry piece of claim 1, where a portion of the cover abuts a lower portion of the ornament when the cover is in the closed position.

12. The jewelry piece of claim 1, further comprising a support member substantially contained in a channel defined in the cover, a portion of the support member abutting a lower portion of the ornament when the cover is in the closed position.

13. The jewelry piece of claim 1, the first mating element and the second mating element each comprising a hook.

14. The jewelry piece of claim 1, further comprising a bail.

15. A setting for an ornament, the setting comprising:

a body defining a first void for removably receiving the ornament and comprising an open top, a bottom, and a perimeter wall connecting the open top and the bottom;

a back hingedly connected to the body and comprising a back coupling member;

a locking element substantially housed in a second void defined in the perimeter wall, the locking element comprising an arm;

where a first end of the arm comprises an arm coupling member, and a second end of the arm is connected to a spring;

where the setting is in a locked position when the back coupling member and the arm coupling member are coupled;

where the setting is moveable to an unlocked position when the spring is compressed and the arm pivots to decouple the back coupling member and the arm coupling member; and where a portion of the ornament is visible through the open top of the body when the ornament is received in the body and the setting is in the locked position.

16. The setting of claim 15, where the arm pivots about an axis proximate a center of the arm.

17. The setting of claim 15, where at least a portion of the second end of the arm extends through a portion of an exterior surface of the perimeter wall when the setting is in the locked position.

18. The setting of claim 15, where the back coupling member is not visible from an exterior of the setting when the setting is in the locked position.

19. The setting of claim 15, where a portion of a crown of the ornament is in contact with a portion of the body, and a portion of a bottom of the ornament is in contact with a portion of the back, when the setting is in the locked position.

20. A setting for an ornament, the setting comprising:

a housing defining a first cavity for receiving the ornament, the housing open at opposing ends with an open top end having a portion that abuts an upper portion of the ornament when the ornament is received in the housing so as to display a crown of the ornament in an open top of the housing;

a cover comprising a cover mating element, the cover hingedly coupled to an open bottom end of the housing to be moveable to a closed position overlying at least a portion of a bottom end of the housing;

a locking mechanism substantially contained in a second cavity defined in a sidewall of the housing, the sidewall connecting a top end and the bottom end of the housing, and the locking member comprising a lever;

where the lever comprises a lever mating element proximate a first end of the lever, a second end of the lever is coupled to a spring, and a portion of the lever extends through a portion of an exterior surface of the sidewall when the cover is in the closed position;

where the cover mating element and the lever mating element disengage when the spring is compressed and the lever pivots about an axis proximate a center of the lever; and where the ornament is held in abutment against the portion that abuts the upper portion of the ornament when the cover mating element and the lever mating element are engaged.

* * * * *